United States Patent [19]

Del Fabro

[11] 4,072,036

[45] Feb. 7, 1978

[54] BENDING MACHINE

[76] Inventor: Marcello Del Fabro, Villaggio Morena 2, Reana Del Rojale (Udine), Italy, 33010

[21] Appl. No.: 757,666

[22] Filed: Jan. 7, 1977

[30] Foreign Application Priority Data

Jan. 8, 1976 Italy ..... 83302/76

[51] Int. Cl.[2] ..... B21D 7/02; B21F 1/00

[52] U.S. Cl. ..... 72/217; 72/388; 140/71 R; 140/105

[58] Field of Search ..... 72/149, 216, 217, 307, 72/387, 388; 140/71 R, 102, 105

[56] References Cited

U.S. PATENT DOCUMENTS

| | | | |
|---|---|---|---|
| 2,770,262 | 11/1956 | Gauci | 140/71 R |
| 3,245,433 | 4/1966 | Taylor | 140/71 R |
| 3,286,500 | 11/1966 | Weiss | 72/217 |
| 3,872,896 | 3/1975 | Yoshimura | 140/71 R |
| 3,991,600 | 11/1976 | Del Fabro et al. | 72/217 |

FOREIGN PATENT DOCUMENTS

| | | | |
|---|---|---|---|
| 559,711 | 9/1932 | Germany | 72/388 |
| 1,243,952 | 7/1967 | Germany | 72/217 |
| 1,011,988 | 12/1965 | United Kingdom | 140/102 |

*Primary Examiner*—E. M. Combs

*Attorney, Agent, or Firm*—Browdy and Neimark

[57] ABSTRACT

A rod and wire bending machine including at least one bending unit substantially including a fork member, which guides the wire or rod to be bent, and a disengaged bending pin rotating coaxially about the fork member for the bending of the rod. To obtain the rod-forward/backwardfeed, the fork member lodges a roller, operating in couple with an opposed roller in such a way, that the side edges of the opposed extremities of the fork member project from the roller forming two projecting extremities to cause the rod to move forward and backward between the projecting extremities and its the roller and an opposed one, while the rod is laterally guided by the opposed extremities of the fork member, in order that the bending pin has the capacity to effect bendings about one or the other of the pendants constituted by the two projecting extremities of the fork member.

12 Claims, 16 Drawing Figures

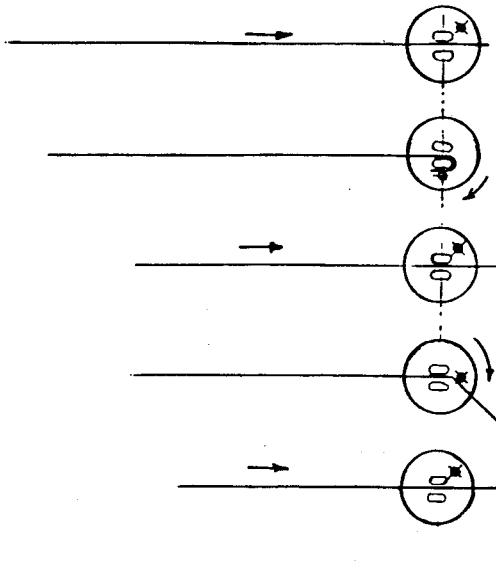
FIG. 5
FIG. 6
FIG. 7
FIG. 8
FIG. 9
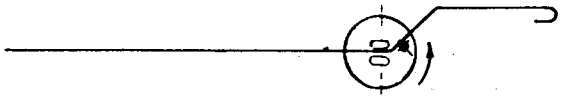
FIG. 10
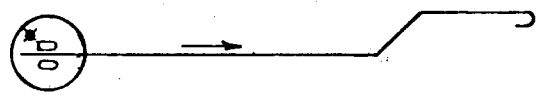
FIG. 11
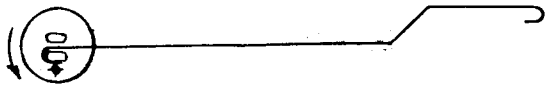
FIG. 12
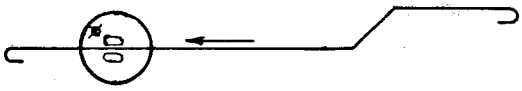
FIG. 13
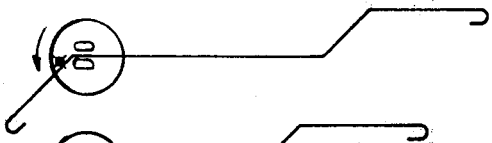
FIG. 14
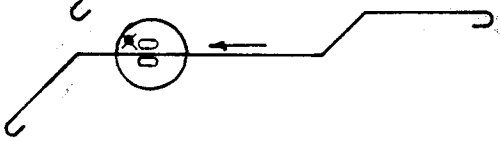
FIG. 15
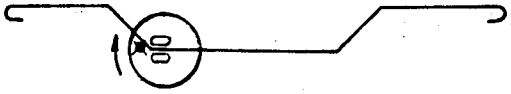
FIG. 16

BENDING MACHINE

FIELD OF THE INVENTION

The present disclosure relates to a rod and wire bending machine, the terms "rod" and "wire" being considered in their most general meaning.

In fact, the word "rod" includes any metal crop end cut in suitable length, like rods, round-sectioned bars, polygonal bars, etc., structurals of different shapes, round-sectioned pipes, square-sectioned pipes, etc..

The word "wire" indicates the metal, wound in spools and, therefore, it includes also the abovementioned rods wound in spools. Obviously said rods in spools will have to be automatically — and also separately — straightened upstream the bending machine of this invention using known means of the modern technology. Also the metal feeding can be carried out both manually and automatically when use is made of the modern technological devices in this field.

The bending machine of the present disclosure is best employed in the preparation of shapes having a notable length in rods — smooth or uneven — which will be used as reinforcement in reinforced concrete layers cast in situ or for the production of pre-fabricated products.

However, the bending machine of this disclosure can also be employed to obtain stirrups for the same uses or any other desired use, which requires the bending of metallic material for different employments and aims.

BACKGROUND OF THE INVENTION

Presently, the already-known bending machines and apparatus for bending rods and the like are numerous, giving solutions more or less mechanized and automatic. But all the known highly mechanized machines are principally designed to specific fields of employment and their use being specific, their versatility is remarkably reduced.

A notable level of mechanization and automation is shown by the stirrup machines. But they aren't suitable to bend rods as to obtain forms of big sizes. They are designed to bend progressively the rod during its feed so to accomplish its bending and to cut the form obtained, which usually has a small size (e.g.:stirrups).

To obtain big-sized shapes special apparatuses have been built, like the one of the Italian Pat. No. 976700 (filed on Feb. 16, 1973) in the name of the same inventor, corresponding to G.B.-Pat. No. 1435 033, Swiss-Pat. No. 573 273, French-Pat. No. 74038350. Considering said patent, the necessity to bend big shapes is fulfilled by bending long rods employing two-rod bending machines disposed on track means in spaced relationship to each other so to be movable towards and away from each other. Such a solution requires a high cost of operation. Moreover, this way shapes with very short sides are obtained with a certain difficulty.

As a matter of fact, it is difficult, to obtain shapes having short sides also when using traditional bending or stirrup machines as they always have feed means placed upstream the bending unit itself. Furthermore, the known machines having rod-feed units cannot perform bendings which are over the theoretical 180°. The known bending methods most of the time lead to the production of shapes which don't lie entirely on the same plane because of the anisotropy of the material and of the non-perfect symmetry of the bending means.

SUMMARY OF THE INVENTION

It is accordingly an object of the present invention to over come the disadvantages of the prior art as mentioned above. The aims of the bending machine more precisely are:

- to permit the bending of a large variety of rods or wire in order to obtain an indefinite plurality of shapes with no limits of dimensions;
- to be employed particularly to execute shapes having big sizes, even though it is able to carry out also smaller shapes when necessary (ex.:stirrups);
- to be provided with a rod-feed device and able to bend, in special conditions, the rod according to angles of 360°;
- to be able to produce shapes having very small sides;
- to be able to bend a rod at each end using the same bending unit both symmetrically and asymmetrically;
- to execute shapes which lie as much as possible in the same plane whenever it is required.

In the present invention these objects are reached by a bending machine whose bending unit includes the rod-feeding device — consisting of a traditional couple of rollers — located axially and in a central position.

According to the disclosure, the bending machine is therefore constituted by at least one bending unit which is provided with a couple of rollers for the rod-feed on the base, at least one of the rollers being combined with a supporting fork member and in which the fork member acts as opposite side pendant on the base for the rodfeed. A bending pin rotates in a clock-wise and anticlock-wise direction for 360° and even more about the forkmember driven by a manual or programmed control.

According to a preferred embodiment both the fork member associated to one of the two rollers, and the bending pin are separately or unitedly retractable.

According to a further preferred embodiment of the invention the roller associated to the fork member acts as pendant, the opposite roller acting as drive roller.

According to a further preferred embodiment of the invention the fork member with the relative pendant roller and the bending pin are mounted coaxially.

According to a further preferred embodiment of the invention the bending unit operates on a horizontal base in which the rod-feed roller, drive roller, is placed at the same level of the base.

According to a further preferred embodiment of the invention, the bending unit includes the fork member with the pendent roller and the eccentric bending pin rotating around the fork member, the bending pin being mounted coaxially to the fork member. The pin moves along a track or truck under dynamic-fluid control by means of a double-acting drive cylinder. When moving axially, the coaxial fork member is driven by a dynamic-fluid drive cylinder which is mounted in the unit. The same dynamic-fluid cylinder controls the fork member in the track or truck which supports the entire unit moving axially.

According to a further preferred embodiment of the invention the bending machine so conceived is provided with just one control unit.

According to a further preferred embodiment of the invention the bending machine has a shape similar to that of a sewing-machine. The bending unit is placed where the sewing unit of the sewing-machine is usually located and the workbase is horizontal, while the unit moves vertically and it is positioned over the work base.

According to a further preferred embodiment of the invention the work base is constituted by a flat surface stretching along the two sides of the direction in the rod-forward/backward-feed while the shape similar to a sewing-machine passes to a vertical position which is perpendicular to said work base.

According to a final preferred embodiment of the invention the couple of forward/backward-feed rollers loosens the clamping of the rod before each bending so that the portion of rod which has already been bent can fall on the work base.

BRIEF DESCRIPTION OF THE DRAWINGS

In order that the invention may be more readily understood, reference is made to the accompanying drawings illustrating by way of example the machine constructed according to the invention and considering all the cited preferred embodiments.

In these drawings:

FIGS. 5 to 16 illustrate, by way of example only, one of the possible ways to operate, forming the opposite ends symmetrically.

DETAILED DESCRIPTION OF THE PREFERRED EMBODIMENT

Figure 1:
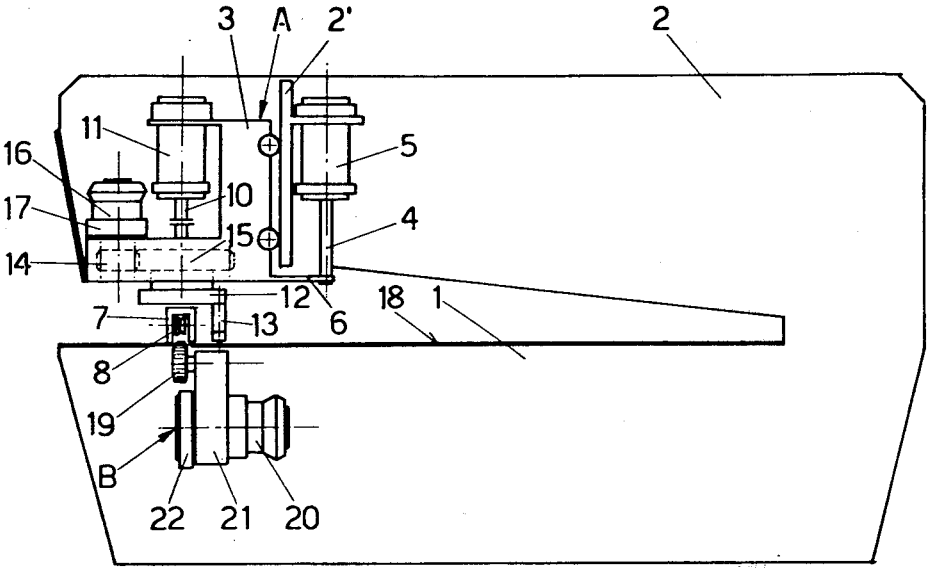
FIG. 1 is a schematic side view of the machine on the plane which is perpendicular to the right rod forward-/backward-feed trajectory and it illustrates the forming and rod-forward/backward-feed units with their controls.
Figure 2:
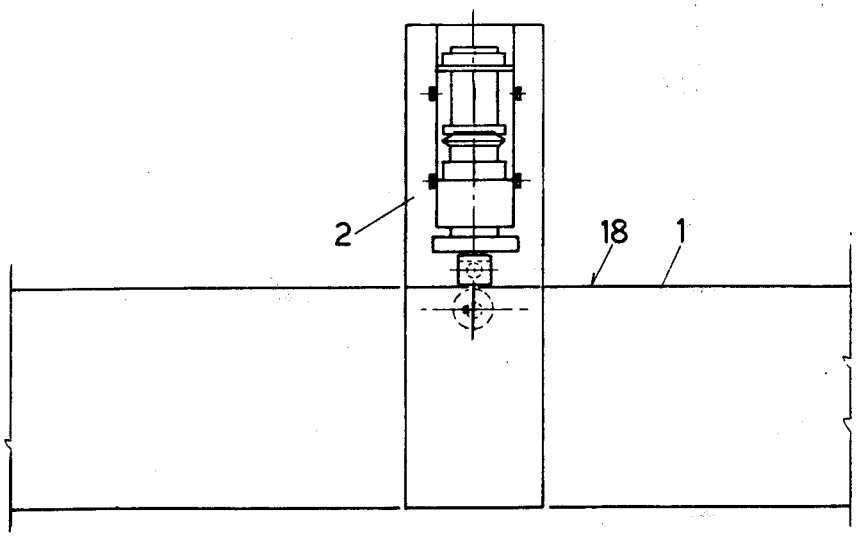
FIG. 2 is a schematic front view of the machine shown in FIG. 1.
Figure 3:
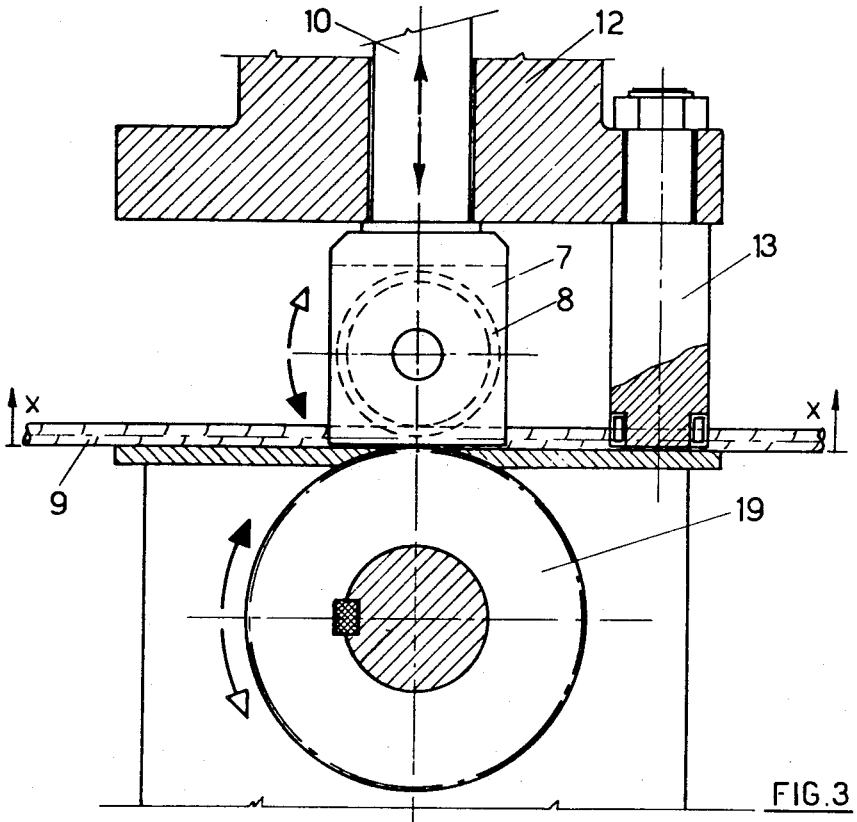
FIG. 3 is an enlarged schematic axial view on the vertical plane, passing along the rod forward/backward-feed of the bending unit operative part.
Figure 4:
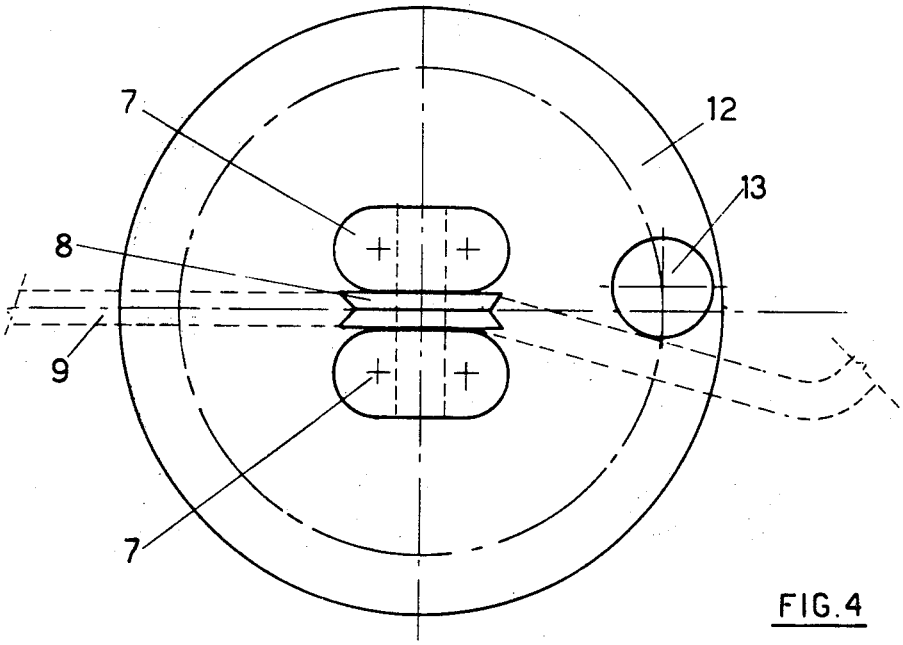
FIG. 4 is a schematic bottom view on line X—X of FIG. 3 lying on the work base.

According to FIGS. 1, 2, 3, 4 the apparatus includes a base 1 in the center of which there is a perpendicular upstanding structure 2 with the same shape as a sewing-machine. The operative bending unit "A" overhangs from the upper end of said structure and it is associated to the rod forward/backwardfeed device placed below the base "B".

The unit "A" is constituted by a truck running along a slideway 2' fastened to the machine frame 2. The truck 3 gets vertical motion from a shaft 4 of a piston - dynamicfluid cylinder set 5, fixed to the structure 2 by means of 2'. The shaft 4 makes the truck 3 slide axially by means of the connecting arm 6. The truck 3 supports the fork member 7, which, in its turn, supports the wheel 8 for the rod to be bent 9. The fork member 7 is connected through its axis to the shaft 10 of a piston — dynamic-fluid cylinder 11 anchored to the truck 2, so that the fork member 7 and roller 8 can be moved axially with respect to the truck 3

A disengaged disc 12 supporting a bending pin 13 is mounted coaxially to the fork member 7 and roller 8. The disc is made to rotate by a toothed gearing 14, 15 by means of a motor 16 that a program-controlled rotating pulse generator 17 controls in its rotation.

The whole set just above described is supported in the truck 3, so that the fork member 8 and the pin 13 skim the work base 18 when they are at their maximum lowered position. The fork member and pin are retractable upwards and downwards either together or independently if acting on the relative cylinders 5, 11 to a suitable extent which is equivalent to at least the overall cross-section of the rod to be formed.

The unit "B" includes a drive roller 19 which is opposed to the roller 8, the roller 19 being toothed and projecting from the base 18 at a convenient short extent for the rod forward/backward-feed. The unit "B" also includes a motor draft gear 20 controlling the mentioned roller by means of a toothed gearing 21 whose rotation is driven by a program-controlled pulse generator 22, just like the not-shown 17. According to known techniques, the rod forward/backward-feed, the bending direction, and the bending extent will be entered in the program.

In order to cause the reversal of the draft gear, the motor 20 is reversible or the toothed gearing 21 can be provided with a reverse gear. The motor 16 or its toothed gear will have the same characteristic of the motor 20 or its toothed gear 21.

The working of the forming bending machine is readily understood from the description hereinafter made of an operative program for the execution of the shape in FIG. 16, only as an example.

First the roller 19 and opposed roller 8 drive forward the rod in FIG. 5 at a fixed extent, then the first clockwise bending is obtained as shown in FIG. 6: the bending pin 13 rotates about the fork member 7 at a fixed extent. After the return of the bending pin to the initial position, the rod is moved forward again, as shown in FIG. 7 and a second bending is carried out, with following return of the bending unit to the initial position. Succesively the rod is moved forward again as shown in FIG. 9; the bending pin 13 and the associated disc 12 retract, passing on the other side of the rod, where, being lowered in a position such as to skim the base, they cause an opposite anticlockwise bending FIG. 10. At this moment, the bending of rod extremity is accomplished and the rod keeps on moving forward as far as the opposed extremity which hasn't been bent yet. Excluding a disengaged piece of rod as long as that at the beginning of the bending FIG. 11. In the meantime, the bending pin retracts. It passes again to the other part of the rod in a position so as to execute bendings on the opposite side. This way it performs the first symmetrical bending of the eyelet FIG. 12 and returns to its position, allowing the rod to move forward in the opposite direction, pushed by the central couple of rollers FIG. 13. Then the bending pin executes the relative bending FIG. 14, returns to its position and the rod starts moving forward again FIG. 15. The bending rod 13 shifts again to the other side of the rod and carries out the final bending FIG. 16. The bending unit (that is: bending pin and fork member) retracts and the shape can be taken out as it is ready.

To avoid the default due to the non-homogenous rod and causing each bending not to lie perfectly on the work base, a characteristic innovation of this method is represented by a momentary loosening of the clamp between the forward-feed roller 19 and the opposed roller 8 of the fork member 7. This way the shaped form having the bent side not perfectly lying on the plane, will fall on the plane, so that the following bending will be executed on the plane which is the same as of the bending obtained before.

It will be apreciated that the invention isn't to be considered just within the limits of the above described and illustrated embodiments. As a matter of fact, they can be considered starting points for different realizations and the technical details can vary without exeeding the substance of the invention as it has been announced and hereinafter claimed.

What is claimed:

1. A rod and wire bending machine comprising, in combination:

at least one bending unit including a fork member with two opposed extremities having a pair of facing side edges for laterally guiding a rod or wire therebetween and at least one pair of projecting ends extending outwardly from each side edge of each extremity, and a bending pin spaced from said fork member and mounted on a disc which is rotatable about said fork member and at least one feeding unit including a first roller mounted on said fork member and positioned between the facing side edges of said extremities, said first roller being dimensioned to extend within said projecting ends, and an opposed second roller mounted in alignment with and opposite to said first roller and rotatable in either direction for clamping and feeding a rod or wire in either a forward or backward direction between said rollers and said facing side edges of said opposing extremities and beyond said pairs of projecting ends whereby said bending pin may be rotated in either direction to bend a rod or wire around a preselected projecting end of either extremity of said fork member.

2. A bending machine according to claim 1, wherein said fork member and said first roller are disposed coaxially and said fork member and first roller are conjointly and separately moveable relative to said bending pin.

3. A bending machine according to claim 1, wherein the machine has a C-shape profile in cross section in a plane perpendicular to a plane defined by the axes of rotation of said first and said opposed rollers.

4. A bending machine according to claim 2, including a work base, and wherein said fork member and said bending pin are positioned opposite said work base upon which the bent rod or wire is caused to slide in either said forward or backward direction.

5. A bending machine according to claim 4, wherein said movement of said fork member, said first roller, and said bending pin is perpendicular to said work base.

6. A bending machine according to claim 4, wherein said work base is horizontal.

7. A bending machine according to claim 6, wherein said machine further includes a control means for permitting the rod or wire to be momentarily released from said clamping between said first roller and said opposed roller before a subsequent bending so as to enable said rod to lie upon said work base, for changing the position of said rod or wire relative to said rollers and for reclamping it before a subsequent bending.

8. A bending machine according to claim 4, wherein said work base extends for a considerable length to both sides of a plane perpendicular to a plane defined by the axes of rotation of said first and said opposed rollers.

9. A bending machine according to claim 2, wherein said fork member and said bending pin are positioned in an operative plane and are separately and conjointly retractable from said plane.

10. A bending machine according to claim 9, wherein said opposed roller is positioned so that its peripheral, rod-engaging suface is tangent to said plane..

11. A bending machine according to claim 9, wherein said opposed roller is a drive roller, and its peripheral, rod-engaging surface extends slightly above said plane and said first roller is a freely rotatable roller.

12. A bending machine according to claim 9, including a work base wherein said bending unit and said feeding-feed unit are coplanar and wherein said first roller, said fork member and said opposed roller are positioned so that their rotational axes are horizontal and parallel to said operative plane.

* * * * *